US011719041B2

(12) United States Patent
Chat

(10) Patent No.: US 11,719,041 B2
(45) Date of Patent: Aug. 8, 2023

(54) DRIVE SYSTEM DRIVING A SCREEN, AND APPARATUS COMPRISING SUCH A SYSTEM

(71) Applicant: SOMFY ACTIVITES SA, Cluses (FR)

(72) Inventor: Alexandre Chat, Brenthonne (FR)

(73) Assignee: SOMFY ACTIVITES SA, Cluses (FR)

( * ) Notice: Subject to any disclaimer, the term of this patent is extended or adjusted under 35 U.S.C. 154(b) by 135 days.

(21) Appl. No.: 17/259,068

(22) PCT Filed: Jul. 10, 2019

(86) PCT No.: PCT/EP2019/068502
§ 371 (c)(1),
(2) Date: Jan. 8, 2021

(87) PCT Pub. No.: WO2020/011836
PCT Pub. Date: Jan. 16, 2020

(65) Prior Publication Data

US 2021/0140233 A1 May 13, 2021

(30) Foreign Application Priority Data

Jul. 11, 2018 (FR) ..... 1856377

(51) Int. Cl.
*E06B 9/60* (2006.01)
*E06B 9/42* (2006.01)
*E06B 9/72* (2006.01)

(52) U.S. Cl.
CPC ..... *E06B 9/60* (2013.01); *E06B 9/42* (2013.01); *E06B 9/72* (2013.01)

(58) Field of Classification Search
CPC ..... E06B 9/60; E06B 9/42; E06B 9/72; E06B 9/56
See application file for complete search history.

(56) References Cited

U.S. PATENT DOCUMENTS 322,347 A 7/1885 Carey
5,975,186 A * 11/1999 Day ..... E06B 9/50 160/321

FOREIGN PATENT DOCUMENTS

| | | |
|---|---|---|
| EP | 0 666 405 | 8/1995 |
| FR | 830.401 | 7/1938 |
| JP | 2003-314167 | 11/2003 |
| JP | 2005-54374 | 3/2005 |

OTHER PUBLICATIONS

Search Report for FR Application No. 1856377 dated Mar. 20, 2019, 2 pages.
International Search Report for PCT/EP2019/068502 dated Oct. 7, 2019, 5 pages.
Written Opinion of the ISA for PCT/EP2019/068502 dated Oct. 7, 2019, 5 pages.

* cited by examiner

*Primary Examiner* — Beth A Stephan
(74) *Attorney, Agent, or Firm* — Nixon & Vanderhye

(57) ABSTRACT

Disclosed is a drive system for driving a screen, that includes an actuator designed to drive in rotation a winding shaft associated with the screen, and a compensation spring. The compensation spring includes a first series of tums having a first spacing; and at least one second series of turns having a second spacing, with a value that is greater than the value of the first spacing.

19 Claims, 3 Drawing Sheets

DRIVE SYSTEM DRIVING A SCREEN, AND APPARATUS COMPRISING SUCH A SYSTEM

BACKGROUND OF THE INVENTION

Field of the Invention

The invention relates to a drive system for driving a screen, in particular a roll-up screen. The invention also relates to an installation for a closure system, screening/blackout system or solar protection system that comprises such a drive system.

Description of the Related Art

In a conventional manner, an installation for a closure system, screening/blackout system or solar protection system comprises a movable screen that is movable between two positions referred to as end-of-travel positions, in particular a roll-up screen, such as a flexible shutter-apron, for example a shutter-apron formed by slats connected to one another in an articulated manner in the case of a roller shutter, or screening material. The closure system installation also comprises a winding shaft, for example a winding tube on which is fastened and wound the roll-up screen or a shaft on which is wound a cord or a tape of the screen. The installation also includes a drive system that comprises an actuator comprising an electric motor, the actuator driving the winding shaft in rotation in order to deploy or fold (retract) the screen. The screen is therefore moved so as to be facing an opening in order to selectively close the latter. The weight of this screen (weight of the shutter-apron itself or the weight of a bar referred to as weighted "front bar", intended to facilitate the lowering of a screening material, under the effect of the combined weight of the screening material and the front bar) exerts on the drive system a variable torque, in particular as a function of the position of this screen.

In a conventional installation, with the unwinding or lowering of the screen taking place under the effect of the weight of the unwound portion of the screen, the consumption of electrical power is minimal. On the other hand, the forces to be exerted in order to wind up or raise the screen are substantial and therefore induce a penalty in terms of the overall consumption of electrical power by the installation.

SUMMARY OF THE INVENTION

The object of the present invention is to provide a closure system—, screening/blackout system—, or solar protection system installation, as defined above, whereof the consumption of electrical power is low, in which, for example, the actuator is supplied with power by means of an independent current source, for example by cells or batteries.

A known practice in the prior art, in order to reduce the power consumption of a screen drive system, is to use springs referred to as "compensation" springs so as to at least partially compensate for the variable torque created by the shutter-apron.

Such a compensation spring makes it possible to generate a torque between a fixed part of the actuator and the winding shaft, this spring being kinematically connected, by one of its ends, with a fixed structure and, by its other end, with a movable part that is connected to the screen, in particular connected to the winding shaft. The purpose of the compensation spring is to accompany the geared motor forming the actuator during the raising of a screening material or another type of screen. In particular, during at least part of the lowering of the screen, the spring is placed under stress. The accumulated energy is then released during at least part of the phase of retracting of the screen.

In order for an installation to function correctly, it is necessary for the compensation force exerted by the spring to be appropriate to the torque developed by the screen which has an impact on the drive means. This torque is a function of the parameters relating to the screen drive system, for example the winding diameter, the dimensions of the screen, its specific weight and its position in relation to the opening. The parameters of the compensation spring, in particular the length of wire and/or the number of turns, are determined as a function of the parameters relating to the drive system for driving the screen. In addition, in order to allow for better balancing of the drive system, the control means for controlling the initial stress of a compensation spring may be provided. At the time of installing the drive system, the electric motor itself may be used for prestressing the compensation spring, in order to adjust the point of equilibrium of the screen. This equilibrium point is preferably provided at a point that is differentiated from the end-of-travel positions of the screen, for example at the mid-point of travel of the screen.

As the compensation spring gets placed progressively under stress, that is to say gets wound about itself and its diameter decreases, it gets elongated. In known systems, the design therefore provides for the installation to stretch the spring in order to provide for sufficient space for the completely wound configuration thereof. In this case, the length of the installed compensation spring is greater than its length at rest and the turns of the installed compensation spring are non-contiguous. This solution is not entirely satisfactory because in this case the spring is not maintained in place, is unstable and generates noise.

Indeed, in particular in the configuration where the compensation spring is installed around the actuator and within the interior of a winding tube, the radial space for the extension or the displacement of the turns in relation to the axis of the winding tube is very limited. Contact between the turns of the spring and the actuator and/or the winding tube generates noise in operation, which is unacceptable.

The patent document JP 2005 054374 describes a drive system for driving a screen that comprises an electric actuator, a winding tube, and a spring, which is not a compensation spring given that it is mounted on the exterior of the winding tube rather than being fastened between a fixed part of the actuator and the winding tube.

It is these drawbacks that the invention seeks to remedy by providing a novel drive system that wherein the compensation spring makes it possible to obtain better performance and reduction in noise.

To this end, the invention relates to a drive system for driving a screen, that comprises an actuator designed to drive in rotation a winding shaft associated with the screen, and a compensation spring. This system is characterized in that the compensation spring comprises a first series of turns having a first spacing; and at least one second series of turns having a second spacing, with a value that is greater than the value of the first spacing.

Thanks to the invention, the compensation spring with spaced turns makes it possible to absorb the extension of the spring under the action of the torque, while also eliminating the noise problems generated by the uncontrollable deformation of the spring, without having to add additional parts. This also makes it possible for the spring to be housed around a tube containing batteries, where there is little space, and to obtain lengthwise space saving.

According to advantageous but non-mandatory aspects of the invention, such a drive system may incorporate one or more of the following characteristic features, taken into consideration in accordance with any technically feasible combination:

The length of the compensation spring at rest is greater than the length of the compensation spring when it is installed in the drive system.

The spacing of the turns of the second series has a value at least 105% that of the spacing of the turns of the first series.

The spacing of the turns of the second series has a distance increase of at least 1 mm as compared to the spacing of the turns of the first series.

The second series of turns is located at one of the ends of the compensation spring between a first end that is fixed to a first fixed part of the drive system and a second end that is fixed to a second rotationally movable part of the drive system.

The second series of turns is located at a distance from the ends of the compensation spring between a first end that is fixed to a first fixed part of the drive system and a second end that is fixed to a second rotationally movable part of the drive system.

The spacing of the first series of turns has a value of zero, the turns being contiguous.

The compensation spring comprises a plurality of series of turns whereof the spacing has a value greater than that of the spacing of the turns of the first series.

The compensation spring comprises a first end that is fixed on an attachment part mounted on a tubular casing of the actuator and a second end that is fixed to an output shaft of the actuator, or to a drive wheel driven by the output shaft, which are intended to be attached to the winding shaft.

The invention also relates to an installation for a closure system, screening/blackout system or solar protection system that comprises a screen, a winding shaft associated with the screen, and a drive system as mentioned here above.

BRIEF DESCRIPTION OF THE DRAWINGS

The invention will be better understood and other advantages thereof will be more clearly apparent in the light of the description which follows, provided by way of non-limiting example with reference to the appended drawings.

DESCRIPTION OF THE PREFERRED EMBODIMENTS

Figure 1:
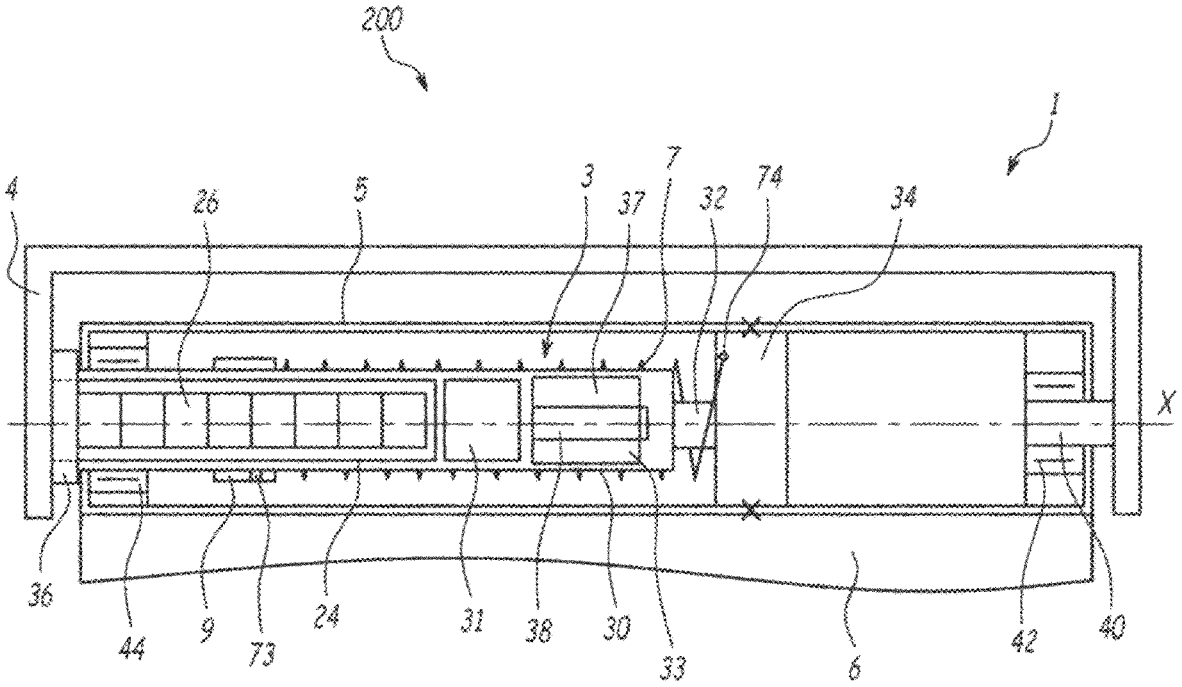
FIG. 1 is a schematic view of a closure system—, screening/blackout system—, or solar protection system installation that comprises a drive system in conformity with the invention.
Figure 2:
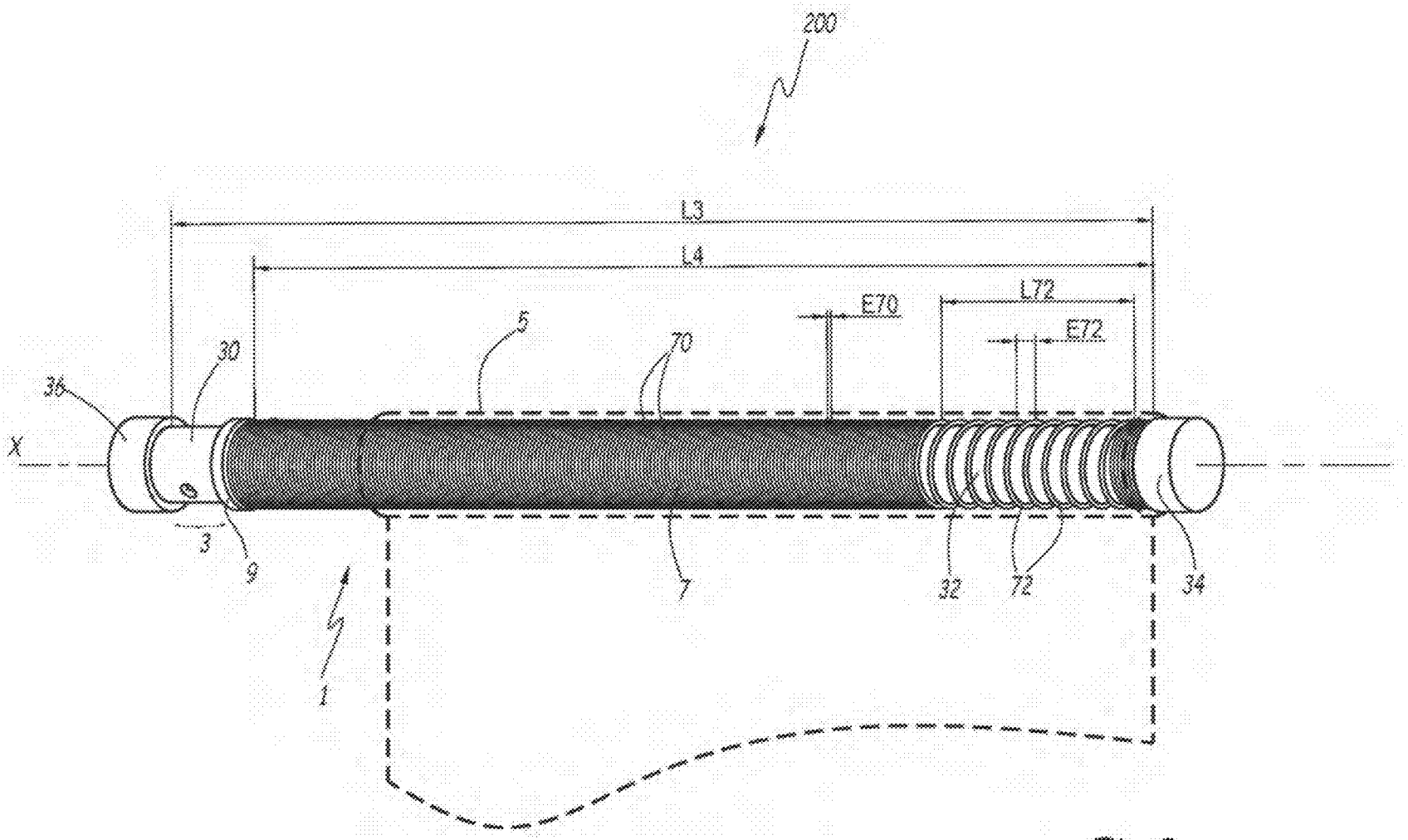
FIG. 2 is a perspective view of a drive system in conformity with the invention.

FIG. 1 represents a drive system 1 for driving a screen 6, in particular a roll-up screen, such as a roller shutter, mounted in a framework of a door opening or window opening of a building. The drive system 1 comprises an actuator 3 designed to drive in rotation a winding shaft 5 in the form of a winding tube of the roll-up screen 6, and a compensation spring 7 that transmits to the winding shaft 5 a torque delivered by the actuator 3. The screen 6, the winding shaft 5, and the drive system 1 form a closure system—, screening/blackout system—, or solar protection system installation 200. The installation 200 also comprises a frame 4 that supports the winding shaft 5.

Also defined is a central axis X or reference axis of the drive system 1, which is a longitudinal axis of the winding shaft 5, the actuator 3, and the compensation spring 7 in the assembled configuration. In the following sections, the terms "axial" and "radial" are used with reference to this central axis X.

The actuator 3 is mounted at least partially within the interior of the winding tube 5 and drives the latter in rotation by means of a connecting component part or drive wheel 34. The winding tube 5 is mounted so as to have the ability to rotate in the frame 4 by means of plain bearings or rolling bearings 42, 44. The actuator 3 is also disposed along the reference axis X. It comprises a tubular housing or tubular casing 30, and housed within the tubular casing 30, a power supply assembly 24, that comprises for example accumulators or power supply batteries 26, an electronic control unit 31, an electric motor 33, as well as a reduction gear and a brake (not shown). Alternatively, the power supply assembly 24 may be housed within a second tubular casing, connected to the tubular casing 30 in which the electric motor 33 is located.

The compensation spring 7, working under torsion around the reference axis X, is mounted around the tubular casing 30 and acts so as to return the winding tube 5 to a wound-up position.

The electric motor 33 of the actuator 3 has a stator 37 that is fixed relative to the casing 30, and a rotor 38 that drives, by means of the reduction gear, an output shaft 32, which drives the winding tube 5 by means of the wheel 34 that is rotationally attached on the output shaft 32 and on the winding tube 5. The electronic control unit 31 ensures the operation of the electric motor 33, in accordance with the movement commands received, by bringing about the connection between the power supply from the accumulators or batteries 26 and the electric motor 33. In this embodiment, the actuator 3 comprises a head 36, which closes one end of the casing 30, and protrudes out to the exterior of the winding tube 5. The head 36 of the actuator serves as the means for supporting the actuator 3 and consequently the winding tube 5, at the locational position of a fixed part of the building. In addition it serves to enable torque take-up at the actuator output. It may be provided with an access hatch, (not shown), for accessing the accumulators or batteries 26 contained in the tubular casing 30.

An attachment part 9 is situated on the tubular casing 30 and fixed so as to be in rotational and translational motion in relation to the tubular casing 30. The first end 73 of the compensation spring 7 is therefore connected to a fixed part of the actuator 3, by means of the attachment part 9, while the second end 74 is connected to a rotating part of the actuator 3 or the winding shaft 5.

Figure 3:
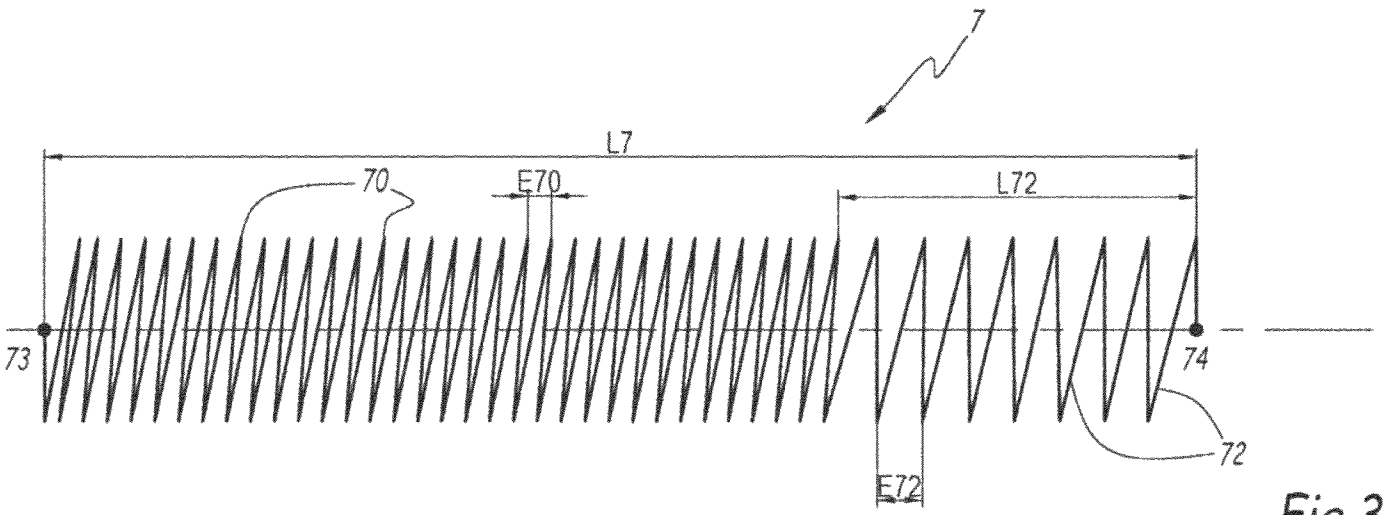
FIG. 3 is a schematic lateral view of a compensation spring of the drive system of FIG. 1 at rest.
Figure 4:
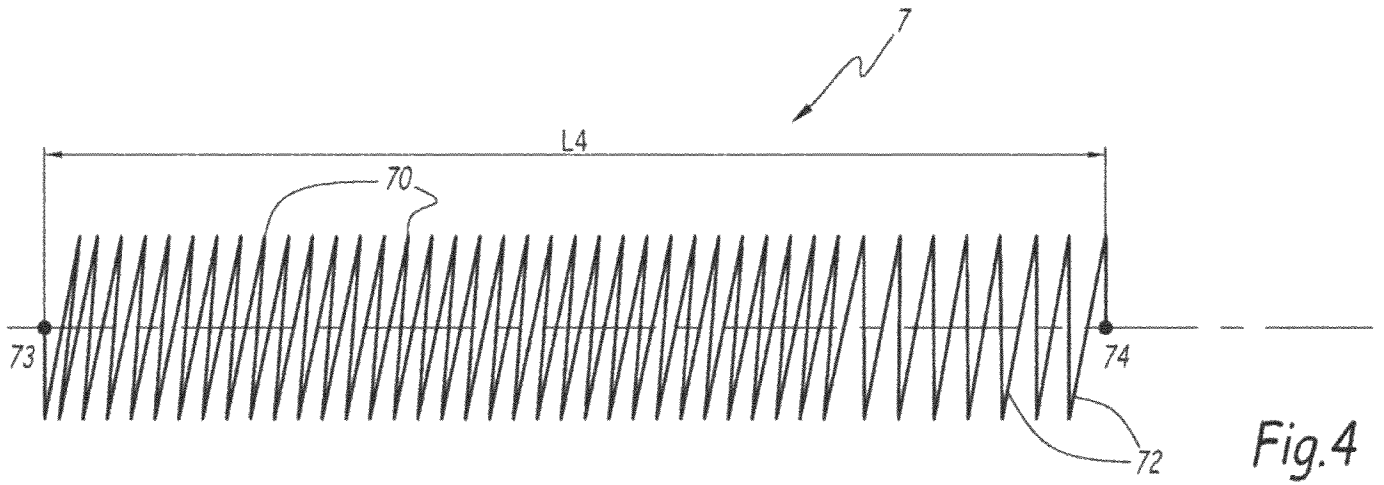
FIG. 4 is a view similar to that of FIG. 3, in a mounted configuration of the compensation spring.

The compensating spring 7 represented in a schematic manner in FIGS. 3 and 4, may, in a known manner, be made up of one or more resilient elements, such as torsion springs, positioned in series or in parallel, in order to obtain the desired characteristic features in terms of extension and stiffness. The compensation spring 7 is fastened to the attachment points of the drive system 1: on the one hand by a first end 73 to the attachment part 9, and on the other hand by a second end 74 to the drive wheel 34 of the winding tube 5, that is itself mechanically bound to the winding tube 5. By way of a variant, the second end may be fastened to the output shaft 32.

The reference L7 denotes the length of the compensation spring 7 at rest, taken along the direction of the reference axis X. The reference L4 denotes the length between the drive wheel 34 and the attachment part 9 along the same direction. This length L4 corresponds substantially to the length of the compressed compensation spring 7. The reference L3 denotes the length of the actuator 3 taken along the same direction. The lengths L7 and L4 are less than the length L3 and the compensation spring 7 does not project out substantially beyond the ends of the actuator 3, which provides the actuator sub-assembly with a compact and monolithic character, thereby simplifying the handling thereof and allowing for savings in installation time.

The length L7 of the compensation spring 7 at rest as well as the length L4 of the compensation spring 7 when installed are defined based on the parameters of the installation 200. In particular, the compensation spring 7 is defined by one or more of the following static parameters:

a Young's modulus value, which characterizes the longitudinal elasticity of the spring wire;

the diameter of the spring wire;

the external diameter in the free state or the rest state;

the internal diameter in the free state or the rest state;

the mean diameter in the free state or the rest state;

the number of turns;

the length of the wire;

the length of the spring in the free state L7;

the stiffness of the spring.

Certain of these static parameters are input parameters, based on which other static parameters, or output parameters, are defined.

The compensation spring 7 is also defined by dynamic parameters, or parameters relating to the torque, among which are included:

the number of turns under torque, which defines in particular the number of turns of the winding shaft necessary for the deployment of the screen 6 over the entirety of its travel;

the angle under torque;

the external diameter under torque;

the internal diameter under torque;

the mean diameter under torque;

the increase in length under torque;

the length of the spring under torque;

the torque;

the stress under torque.

When the drive system 1 is in the operating configuration, the rotation of the electric motor results in the rotation of the drive wheel 34 and a modification in the torque applied to the compensation spring 7, since its second end 74 rotates around the reference axis X with the drive wheel 34 while its first end 73 remains stationary in relation to the tubular casing 30 of the actuator 3 which is itself stationary in relation to the reference axis X.

The modification of the torque applied to the compensation spring 7 modifies its extension, which has the effect of modifying the diameter of the turns and the spacing between the turns of which it is constituted, given that the spacing between the two ends 73 and 74 of the compensation spring 7 is fixed. In particular, when the compensation spring 7 is stressed (that is to say, that it gets wound about itself), its length increases and when the stress is relaxed, the length of the compensation spring 7 decreases.

These variations in length are to be taken into account at the time of sizing the compensation spring 7 so as to ensure that the latter is suitable for the closure system—, screening/blackout system—, or solar protection system installation 200.

To this end, the compensation spring 7 comprises a first series of turns 70, referred to as contiguous turns, which have at rest a first spacing E70; and at least one second series of turns 72, referred to as non-contiguous turns, which have at rest a second spacing E72 with a value that is greater than the value of the first spacing E70.

The distances of the spacings E70 and E72 are taken along the central axis X. The term 'greater' is understood to indicate that the spacing E72 has a value at least 105% that of the spacing E70 or else that the spacing E72 has a distance increase of at least 1 mm as compared to the distance of spacing E70.

At the time of installing the compensation spring 7 relative to the drive system 1, the compensation spring 7 is compressed axially, in a manner so as to bring the non-contiguous turns 72 closer to one another. Thus, the length L4 of the compensation spring 7 when installed is less than the length L7 of the compensation spring 7 at rest. This compression creates axial forces in the direction of the attachment points for attaching the ends 73 and 74 of the compensation spring 7. These axial forces also have the consequence of creating forces on the contiguous turns 70, thereby bringing the latter closer to one another.

The contiguous turns 70 being brought close together serves to stiffen the compensation spring 7, which limits the deflections, displacements and the noise generated during the rotations of the winding shaft 5. In fact, the more the compensation spring 7 is axially rigid, the more it is radially rigid and the uncontrollable deformations of the compensation spring 7 by ripple effect are thus prevented.

The compensation spring 7 with spaced turns also makes it possible to absorb the extension of the compensation spring 7 under the effect of the torque generated by the actuator 3.

In this example, the second series turns 72 is located at the one of the ends of the compensation spring 7.

In the present case, the spacing E70 of the first series of turns 70 has a value of zero, the turns 70 being contiguous. By way of a variant not shown, the spacing E70 may have a non-zero value.

The second series of turns 72 extends over a length L72 of the compensation spring 7 which is determined by a fraction of the total length L of the compensation spring 7. The lengths L72 and L are taken along the central axis X, The number of contiguous turns 70 and the number of non-contiguous turns 72 are determined, for example by using a calculation software, on the basis of: the dimensions, the axial pre-stress, the extension of the spring over the maximum number of turns, the minimum length taken up by the turns when they are fully compressed against each other, and a margin.

By way of a variant not shown, the second series of turns 72 may be located at a distance from the ends of the compensation spring 7.

According to another variant not shown, the compensation spring 7 may comprise a plurality of series of turns 72 whereof the spacing E72 has a value greater than that of the spacing of the turns 70 of the first series. These additional series of spaced turns 72 may be positioned at different places along the central axis X.

The entire set of contiguous turns 70 and non-contiguous turns 72 participates in the compensation of the drive system 1, which serves to ensure that there are no so-called wasted turns. Eventually, it is possible for one or two turns necessary for positioning the ends 73 and 74 of the compensation spring 7 at the attachment points to be provided which are therefore considered as wasted turns, in particular because they are subjected to diameter-wise stress by the attachment part 9 or the drive wheel 34.

The invention makes it possible to reduce the noise of the drive system 1, avoid the "wasting" of turns, and ensure better control of the deformation of the compensation spring 7. This solution also makes it possible to simplify the attachment of the compensation spring 7. In fact, due to the axial stress in the direction of the attachment points for attaching the ends of the compensation spring 7, the two ends 73 and 74 may therefore be simply retracted portions of the compensation spring 7, which happen to be housed in the housings provided for the attachment part 9 and the drive wheel 34. These housings have a primary direction that is parallel to the reference axis X.

The compensation spring 7 having different series of turns involves little or no additional manufacturing costs. The quantity of material is similar to that required for a compensation spring produced in accordance with the principles of the state of the art. At the very most, it would be necessary to carry out a suitable cleaning or treatment process of the surface, in particular of the contiguous turns, in order to ensure that the latter are able to slide against each other. The compensation spring 7 having different series of turns thus effectively addresses the constraints related to radial dimensions and wire length in the field of closure system—, screening/blackout system—, or solar protection system installations.

The invention claimed is:

1. A drive system for driving a screen, comprising:
an actuator configured to drive in rotation a winding shaft associated with the screen; and
a compensation spring,
wherein the compensation spring comprises
a first series of turns having a first spacing, and
at least one second series of turns having a second spacing,
the second spacing being larger than the first spacing,
and wherein the compensation spring comprises
a first end that is fixed on an attachment part mounted on a tubular casing of the actuator, and
a second end that is fixed to one of an output shaft of the actuator or a drive wheel driven by the output shaft.

2. The drive system according to claim 1, wherein the compensation spring has a first length at rest and a second length when installed in the drive system, the first length being greater than the second length.

3. The drive system according to claim 1, wherein the second spacing of the second series of turns has a value at least 105% that of the first spacing of the first series of turns.

4. The drive system according to claim 1, wherein the second spacing of the second series of turns has a distance increase of at least 1 mm as compared to the first spacing of the first series of turns.

5. The drive system according to claim 1, wherein the second series of turns is located at one of the first end or the second end.

6. The drive system according to claim 1, wherein the second series of turns is located at a distance from the first and second ends of the compensation spring between the first end and the second end.

7. The drive system according to claim 1, wherein the first spacing of the first series of turns has a value of zero, the turns of the first series being contiguous.

8. The drive system according to claim 1, wherein the compensation spring comprises a plurality of series of turns whereof a spacing has a value greater than that of the first spacing of the first series of turns.

9. The drive system according to claim 1, wherein the first spacing of the first series of turns has a value of zero, the turns of the first series being contiguous.

10. A closure, screening, or solar protection system installation, that comprises a screen, a winding shaft associated with the screen, and a drive system according to claim 1.

11. The drive system according to claim 2, wherein the second spacing of the second series of turns has a value at least 105% that of the first spacing of the first series of turns.

12. The drive system according to claim 2, wherein the second spacing of the second series of turns has a distance increase of at least 1 mm as compared to the first spacing of the first series of turns.

13. The drive system according to claim 3, wherein the second spacing of the second series of turns has a distance increase of at least 1 mm as compared to the first spacing of the first series of turns.

14. The drive system according to claim 2, wherein the second series of turns is located at one of the first end or the second end.

15. The drive system according to claim 3, wherein the second series of turns is located at one of the first end or the second end.

16. The drive system according to claim 4, wherein the second series of turns is located at one of the first end or the second end.

17. The drive system according to claim 2, wherein the second series of turns is located at a distance from the first and second ends of the compensation spring between the first end and the second end.

18. The drive system according to claim 3, wherein the second series of turns is located at a distance from the first and second ends of the compensation spring between the first end and the second end.

19. The drive system according to claim 4, wherein the second series of turns is located at a distance from the first and second ends of the compensation spring between the first end and the second end.

* * * * *